US007696448B2

(12) United States Patent
Rakus et al.

(10) Patent No.: US 7,696,448 B2
(45) Date of Patent: Apr. 13, 2010

(54) CLOSING PROTECTION MECHANISM FOR A CLOSING ASSEMBLY OVER-TOGGLE LINKAGE

(75) Inventors: Paul R. Rakus, Beaver Falls, PA (US); Andrew L. Gottschalk, Pittsburgh, PA (US); Nathan J. Weister, Darlington, PA (US); Joseph J. Matsko, Beaver, PA (US); Robert M. Slepian, Murrysville, PA (US); Douglas C. Marks, Murrysville, PA (US)

(73) Assignee: Eaton Corporation, Cleveland, OH (US)

( * ) Notice: Subject to any disclaimer, the term of this patent is extended or adjusted under 35 U.S.C. 154(b) by 486 days.

(21) Appl. No.: 11/760,234

(22) Filed: Jun. 8, 2007

(65) Prior Publication Data

US 2008/0302645 A1 Dec. 11, 2008

(51) Int. Cl.
*H01H 9/00* (2006.01)

(52) U.S. Cl. ..... 200/400; 200/308

(58) Field of Classification Search ..... 200/400, 200/401, 500, 501, 308, 303, 307
See application file for complete search history.

(56) References Cited

U.S. PATENT DOCUMENTS

| | | | | |
|---|---|---|---|---|
| 5,762,181 | A * | 6/1998 | Castonguay et al. | 200/400 |
| 5,906,271 | A * | 5/1999 | Castonguay et al. | 200/400 |
| 6,610,949 | B2 * | 8/2003 | Mori et al. | 200/400 |
| 6,646,216 | B2 * | 11/2003 | Fanta et al. | 200/400 |
| 6,864,450 | B1 * | 3/2005 | Chen et al. | 200/400 |
| 7,319,203 | B1 * | 1/2008 | Briggs et al. | 200/400 |

* cited by examiner

*Primary Examiner*—Michael A Friedhofer
(74) *Attorney, Agent, or Firm*—Martin J. Moran

(57) ABSTRACT

The closing protection mechanism provided herein includes a control unit, a sensing switch and a sensing switch actuator. The control unit is coupled to, and in electronic communication with, the trip device. The control unit is structured to receive a sensing switch signal and to provide a control signal to the trip device. The sensing switch coupled to, and in electronic communication with, the control unit. The sensing switch is disposed adjacent to the toggle assembly. The sensing switch is structured to provide a sensing switch signal to the control unit. The sensing switch actuator is disposed on the toggle assembly. The sensing switch actuator is structured to actuate the sensing switch. The sensing switch is structured to be actuated by the sensing switch actuator when the toggle assembly is in the second, over-toggle configuration.

20 Claims, 10 Drawing Sheets

CLOSING PROTECTION MECHANISM FOR A CLOSING ASSEMBLY OVER-TOGGLE LINKAGE

BACKGROUND OF THE INVENTION

1. Field of the Invention

The present invention relates to an electrical switching apparatus operating mechanism and, more specifically to a closing protection mechanism for a closing assembly having an over-toggle linkage.

2. Background Information

An electrical switching apparatus, typically, includes a housing, at least one bus assembly having a pair of contacts, a trip device, and an operating mechanism. The housing assembly is structured to insulate and enclose the other components. The at least one pair of contacts include a fixed contact and a movable contact and typically include multiple pairs of fixed and movable contacts. Each contact is coupled to, and in electrical communication with, a conductive bus that is further coupled to, and in electrical communication with, a line or a load. A trip device is structured to detect an over current condition and to actuate the operating mechanism. An operating mechanism is structured to both open the contacts, either manually or following actuation by the trip device, and close the contacts.

That is, the operating mechanism includes both a closing assembly and an opening assembly, which may have common elements, that are structured to move the movable contact between a first, open position, wherein the contacts are separated, and a second, closed position, wherein the contacts are coupled and in electrical communication. The operating mechanism includes a rotatable pole shaft that is coupled to the movable contact and structured to move each movable contact between the closed position and the open position. Elements of both the closing assembly and the opening assembly are coupled to the pole shaft so as to effect the closing and opening of the contacts. The closing assembly may be actuated manually by a user input or in response to an input from a remote actuator.

The trip device included an over-current sensor, a latch assembly and may have included one or more additional links that were coupled to the toggle assembly. Alternately, the latch assembly was directly coupled to the toggle assembly. When an over-current situation occurred, the latch assembly was released allowing the opening spring to cause the toggle assembly to collapse. When the toggle assembly collapsed, the toggle assembly link coupled to the pole shaft caused the pole shaft to rotate and thereby move the movable contacts into the open position.

Low and medium voltage electrical switching apparatus typically had stored energy devices, such as a closing spring and an opening spring, and at least one link coupled to the pole shaft. The at least one link, typically, included two links that acted cooperatively as a toggle assembly and which were coupled to each other at a toggle joint. When the contacts were open, the toggle assembly was in a first, collapsed configuration and, conversely, when the contacts were closed, the toggle assembly was, typically, in a second, toggle position, that is, an in-line configuration, or in a slightly over-toggle position. The closing spring was usually compressed, or "charged," by a motor or a user utilizing a lever arm. The closing spring, typically, holds more stored energy than the opening springs and during the closing operation wherein the contacts are moved to the second, closed position, the opening spring was charged. The opening spring biased the pole shaft, and therefore the toggle assembly, to the collapsed position. The opening spring and toggle assembly were maintained in the second, toggle position by the trip device.

When the contacts were in the first, open position, the toggle assembly links, which define lines of force, were "folded," typically at an acute angle. When the mechanism was closing, a closing component applied a closing force to the toggle joint. The closing component moved the links until the lines of force, that is, the links, were nearly in-line or on "center." If the fully closed position of the separable contacts was reached before the lines of force were fully in-line, the closing assembly is an "under-toggle" mechanism and the toggle joint continued to rest on the closing component to prevent the toggle joint from collapsing. In this type of closing assembly, the closing component was, typically, a cam. If, during closing, the closing component moved the toggle joint through the in-line position and beyond, the closing assembly is an "over-toggle" mechanism and the toggle joint typically rested upon a stop that is separate from the closing component. That is, the toggle joint typically came to rest on a stop pin that prevented the toggle joint from collapsing in a reverse direction.

In either an under-toggle or over-toggle mechanism, the contacts would initially engage each other when the angle of the lines of force were approaching the in-line position. After the contacts engage, the driving force required to complete the closing of the contacts increases. That is, prior to the contacts engaging each other, the closing component was, essentially, only moving the moving contact and compressing the opening springs. Once the contacts engaged each other, the closing component was required to overcome any electromagnetic forces generated by a current passing through the contacts, as well as, forces created by the contact spring as they were being compressed. If the closing component was not able to overcome these forces, there was a chance that the closing operation could stall. If the closing operation stalls, dangerous arcing may occur at the contacts if the contacts are subject to inadequate force or support, for example is the contacts are held in close proximity or if the contacts slowly separate from each other.

Some under-toggle mechanisms have attributes that mitigate the consequences of a stall. That is, when the closing component is a cam acting upon the toggle joint, the cam surface is rising, that is, increasing in radius, so as to effect the movement of the toggle joint. Such a cam is structured to rotate in a single direction during closing, wherein the radius of the cam is increasing, and subsequent charging, wherein the radius of the cam is generally constant. Thus, if a stall occurs, the cam needs only to be rotated further, such as by charging after the close attempt, to cause the toggle joint to be moved into the proper position.

An over-toggle mechanism, however, is not structured to be supported by the closing component. Typically, the closing component acts upon the toggle joint and is then, slowly, withdrawn during the charging of the closing spring. Thus, unlike an under-toggle mechanism, a stall in such a closing assembly could allow the toggle joint to return to the open configuration. If, for example, the toggle joint is resting on the closing component as it is being slowly withdrawn, the contacts will be slowly separated allowing for dangerous arcing to occur.

It is further noted that a device may have a high-current capacity for withstanding an electrical fault that appears after the device is already closed, but may not have enough mechanical energy to complete a closure on that same fault current. That is, high current flowing in the device adds electromagnetic force to the springs which resist closing and increasing the mechanical energy to close on all such faults would shorten the mechanical life or add cost to the mechanism. The trip device is often self-powered by current passing through the contacts of the electrical switching apparatus, and therefore the trip device is inactive before closing. If a fault current which is higher than the closing, or "making" capacity, but lower than the "withstand" capacity appears in the electrical switching apparatus, the trip device must determine if the operating mechanism is closing, in which case the trip device should trip open to protect against harmful arcing at the contacts due to stalling at less-than-fully-closed, or the operating mechanism was already closed, in which case the trip device should remain closed until the manufacturer or customer-programmed delay time for tripping is reached.

One strategy for immediately tripping an operating mechanism that is closing on a fault above its making capacity is the use of a "time-delay" switch. This type of switch senses the state of the device, typically by sensing the pole shaft position, and connects to the trip device. The switch is held in one state when the device is open, and released to move to its other state when the electrical switching apparatus is closed. The switch assembly typically contains a mass with a relatively light bias spring resulting in an inertial delay off its motion when the device closes. This delay serves as a mechanical memory used by the trip device when a fault current above the making capacity appears. If the switch indicates the "device-closed" position, then the device was already closed some moments before the current appeared and the operating mechanism is not attempting to close on the high current; therefore it is not necessary to trip open to protect against prolonged harmful arcing. If the switch still indicates the "device-open" position, then the device was open moments before and the current flowing is the result of a closure attempt. Thus, the trip device must immediately re-open the contacts to protect against a potential stall.

As a result of its kinematics, an over-toggle mechanism has the characteristic of "over-driving" the contacts as the lines of force passes through in-line, or "center", before settling back to the full closed position. Therefore, in a normal closing, the pole shaft is at the full closed position twice; once before the lines of force reach center, and again after passing through center. A switch sensing the pole shaft position, such as the time delay switch, is not able to discriminate between fully closed and partially-closed, where it could potentially stall. Despite these characteristics, there are some reasons to select over-toggle mechanism for some applications, rather than under-toggle mechanisms.

SUMMARY OF THE INVENTION

The closing protection mechanism provided herein includes a control unit, a sensing switch and a sensing switch actuator. The control unit is coupled to, and in electronic communication with, the trip device. The control unit is structured to receive a sensing switch signal and to provide a control signal to the trip device. The sensing switch is coupled to, and in electronic communication with, the control unit. The sensing switch is disposed adjacent to the toggle assembly. The sensing switch is structured to provide a sensing switch signal to the control unit. The sensing switch actuator is disposed on the toggle assembly. The sensing switch actuator is structured to actuate the sensing switch. The sensing switch is structured to be actuated by the sensing switch actuator when the toggle assembly is in the second, over-toggle configuration.

Thus, the sensing switch detects the "toggle angle" between the lines of force of the toggle assembly and allows for schemes for applying such information to protect against potential stalled closures. The sensing switch of this invention also allows unimpeded tripping motion out of any condition between and including open and closed in this embodiment, the switch is mounted to the mechanism side plate and actuated by a cam lobe at the fixed end of the support link. Preferably, the toggle assembly is driven by a ram assembly as set forth in application Ser. No. 11/693,198, filed Mar. 29, 2007, entitled "SPRING DRIVEN RAM FOR CLOSING AN ELECTRICAL SWITCHING APPARATUS" which is incorporated by reference.

Any time enough current to sense and self-power the trip unit is flowing through the device, a timer, preferably in the control unit, starts counting a number of milliseconds. If the sensing switch does not indicate full closed within the preset time, which may be based on the maximum expected duration of a complete closure at the current range sensed, and could be shorter—including zero delay—if desired to maximize protection at high currents, the electrical switching apparatus trips. Tripping for this reason may create a "cause of trip code" that can be identified by on a display. If a current, even a current close to the "withstand" limit, is sensed, but the sensing switch indicates full-closed, or begins to indicate full-closed within the allowed number of milliseconds, the trip device would sense full successful closure and revert to an appropriate pre-programmed trip delay settings for the current level sensed. Maximum continuity of service is achieved by further sensing the actual outcome in addition to the "predicted" outcome of an attempt to close an individual electrical switching apparatus in its service conditions.

Alternatively, the trip device could be configured not to trip due to a perceived stall condition unless the current is larger than a pre-selected threshold. When the sensing switch reports that the operating mechanism is not fully closed at currents below the threshold, which are less probable events and do not present substantial immediate danger, the contacts would remain closed and a diagnostic code, such as, but not limited to, a unique flashing pattern of a "status" LED could be used to signal a user that the device may not be fully closed, or that there may be a problem with the switch. If an overload or fault current appears later, the trip device would trip the operating mechanism at an appropriate time. This option would further ensure best continuity of service and remove concerns about the reliability of the switch itself or the wiring by eliminating normal-load-current nuisance trips.

It is noted that this configuration has the added benefit of protection when a stalled close occurred with an un-energized primary circuit and then the trip device is later energized when current begins flowing. A time-delay switch would have lost its memory, which extends only a number of milliseconds prior to the appearance of current. A stall is least likely to occur when there is no "electrical load" but is still possible considering the variation and potential "noise factors" a device may be exposed to during its life.

The tolerance band for the point at which the sensing switch changes state to report full closed is the range between in-line configuration and fully closed over-toggle configuration, allowing for practical placement of the sensing switch even with normal product variation. Once the lines of force in the toggle assembly have moved past center, the toggle assembly can be expected to continue to "fully closed" under the forces acting on the toggle assembly. Any position past center constitutes a band where the electrical switching apparatus can safely be considered definitively closed. An over-toggle mechanism has the advantage of this definite band for sensing fully closed, whereas the closed position is less discretely defined on an under-toggle mechanism.

The described closing protection mechanism may also be used as a "trip unit auxiliary switch" that is used on advanced trip units for communicating electrical switching apparatus status, counting close-open operations, and collecting or communicating similar data. Other advantages include its low cost, compactness and mechanical simplicity. It does not require a "mechanical memory" device with its critical balance of force, mass and friction. It is also less susceptible to mechanical shock and insensitive to the electrical switching apparatus orientation.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are so coupled move as one.

As used herein, "operatively engage" when used in relation to a component that is directly coupled to a cam means that a force is being applied by that component to the cam sufficient to cause the cam to rotate.

Figure 1:
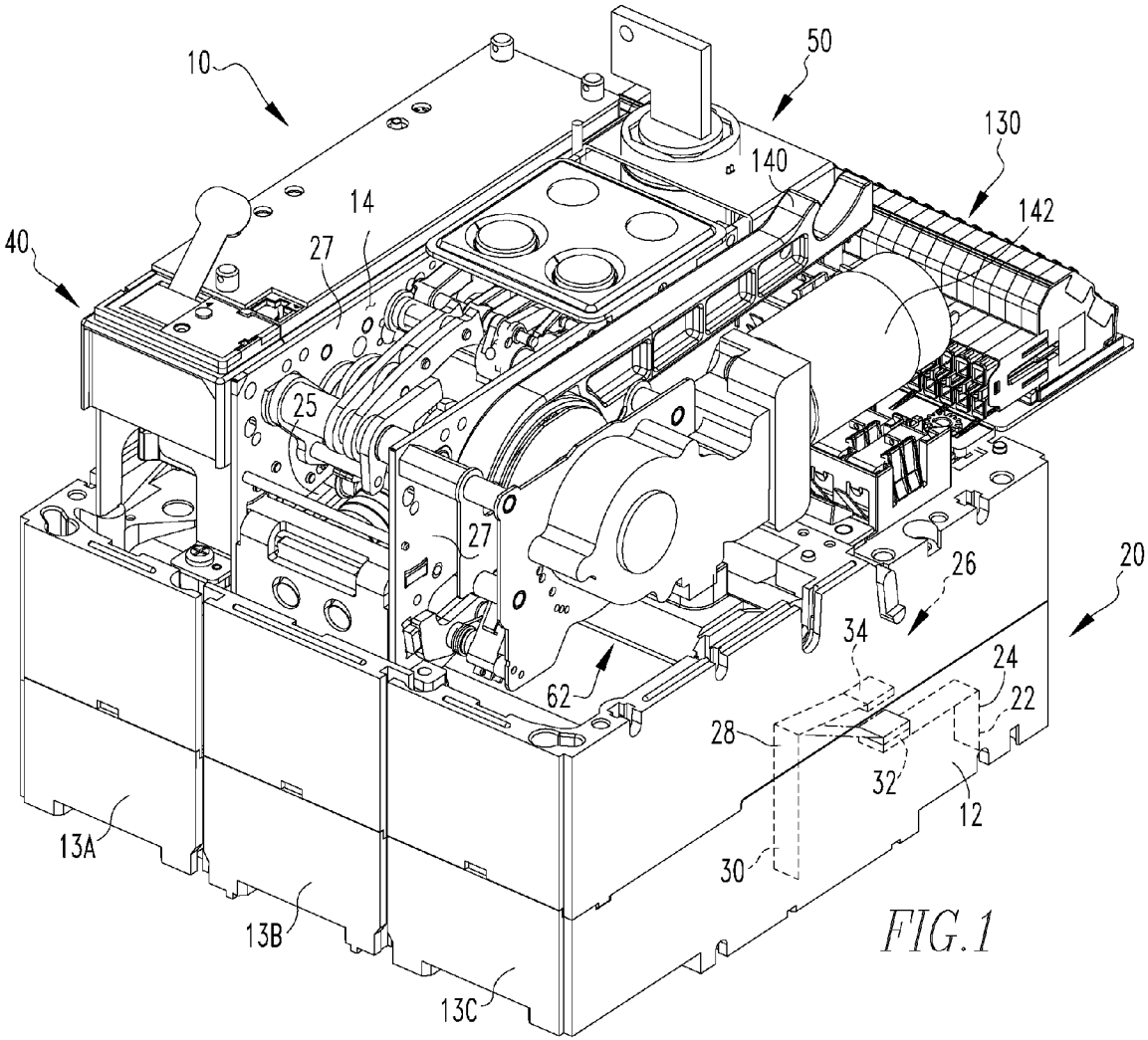
FIG. 1 is an isometric view of an electrical switching apparatus with a front cover removed.

As shown in FIG. 1, an electrical switching apparatus 10 includes a housing assembly 12 defining an enclosed space 14. In FIG. 1, the front cover of the housing assembly 12 is not shown, but it is well known in the art. The electrical switching apparatus 10 further includes a conductor assembly 20 (shown schematically) having at least one line terminal 22, at least one line conductor 24, at least one pair of separable contacts 26, at least one load conductor 28 and at least one load terminal 30. The at least one pair of separable contacts 26 include a fixed contact 32 and a movable contact 34. The movable contact 34 is structured to move between a first, open position, wherein the contacts 32, 34 are separated, and a second, closed position, wherein the contacts 32, 34 contact each other and are in electrical communication. The electrical switching apparatus 10 further includes a trip device 40 and an operating mechanism 50. The operating mechanism 50, which is discussed in more detail below, is generally structured to move the at least one pair of separable contacts 26 between the first, open position and the second, closed position. The trip device 40 is structured to detect an over current condition and, upon detecting such a condition, to actuate the operating mechanism 50 to open the at least one pair of separable contacts 26.

The electrical switching apparatus 10 also includes at least two, and typically a plurality, of side plates 27. The side plates 27 are disposed within the housing assembly 12 in a generally parallel orientation. The side plates 27 include a plurality of openings 29 to which other components may be attached or through which other components may extend. As discussed below, the openings 29 on two adjacent side plates 27 are typically aligned. While side plates 27 are the preferred embodiment, it is understood that the housing assembly 12 may also be adapted to include the required openings and/or attachment points thereby, effectively, incorporating the side plates 27 into the housing assembly 12 (not shown).

An electrical switching apparatus 10 may have one or more poles, that is, one or more pairs of separable contacts 26 each having associated conductors and terminals. As shown in the Figures, the housing assembly 12 includes three chambers 13A, 13B, 13C each enclosing a pair of separable contacts 26 with each being a pole for the electrical switching apparatus 10. A three-pole configuration, or a four-pole configuration having a neutral pole, is well known in the art. The operating mechanism 50 is structured to control all the pairs of separable contacts 26 within the electrical switching apparatus 10. Thus, it is understood selected elements of the operating mechanism 50, such as, but not limited to, the pole shaft 56 (discussed below) span all three chambers 13A, 13B, 13C and engage each pair of separable contacts 26. The following discussion, however, shall not specifically address each specific pair of separable contacts 26.

As shown in FIG. 2, the operating mechanism 50 includes an opening assembly 52, structured to move the at least one pair of separable contacts 26 from the second, closed position to the first, open position, and a closing assembly 54, structured to move the at least one pair of separable contacts 26 from the first, open position to the second closed position. The opening assembly 52 and the closing assembly 54 both utilize common components of the operating mechanism 50. The opening assembly 52 is not part of the claimed invention, however, for the purpose of the following discussion, it is understood that the opening assembly 52 is the assembly structured to move various components to the positions discussed below. Further, it is noted that the opening assembly 52 includes a cradle assembly 53 that, among other functions, acts as a toggle stop and as a toggle kicker for the toggle assembly 58 (discussed below).

Figure 2A:
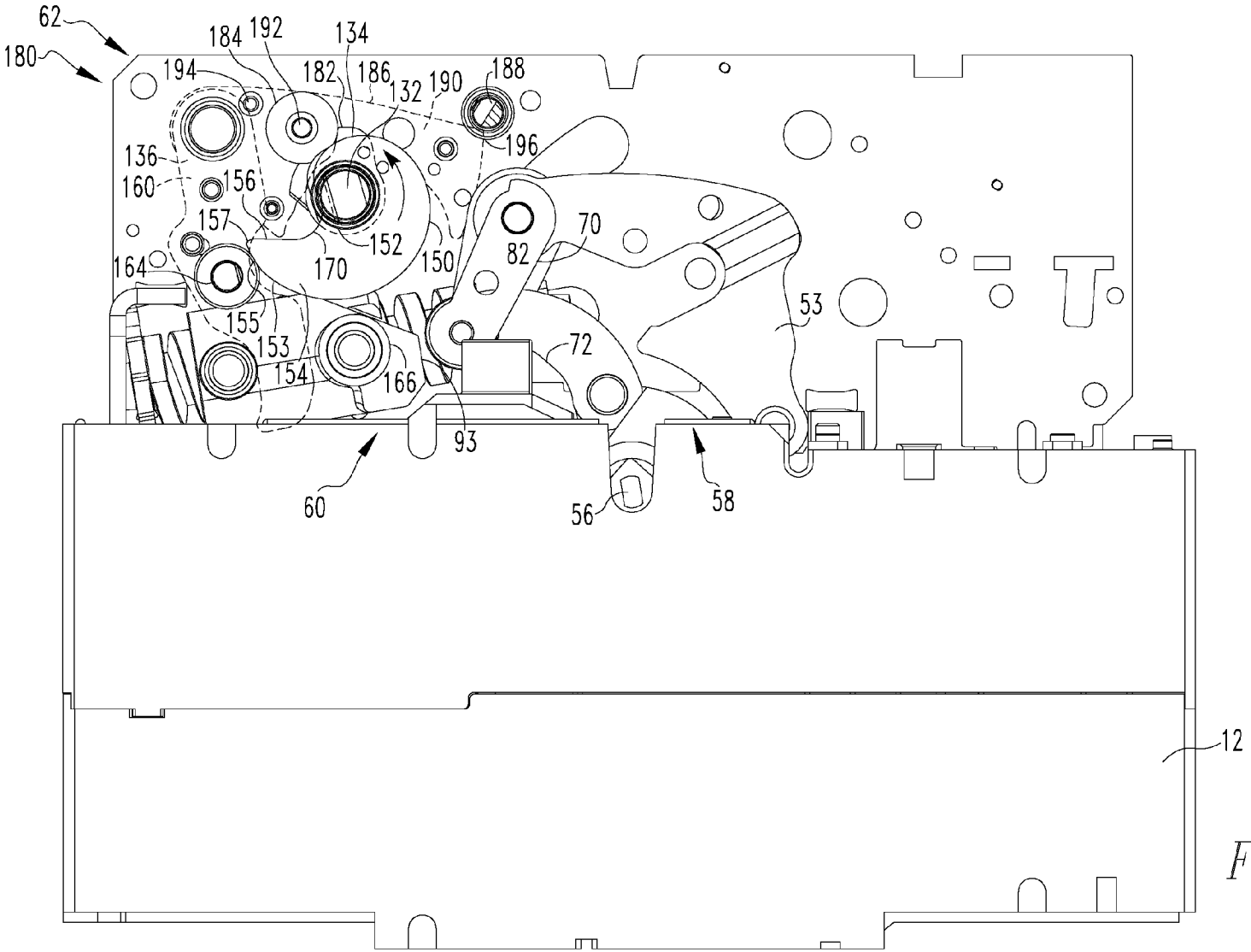
FIG. 2A is a side view of an electrical switching apparatus with a front cover removed and selected components removed for clarity and with the latch assembly in a first position.
Figure 2B:
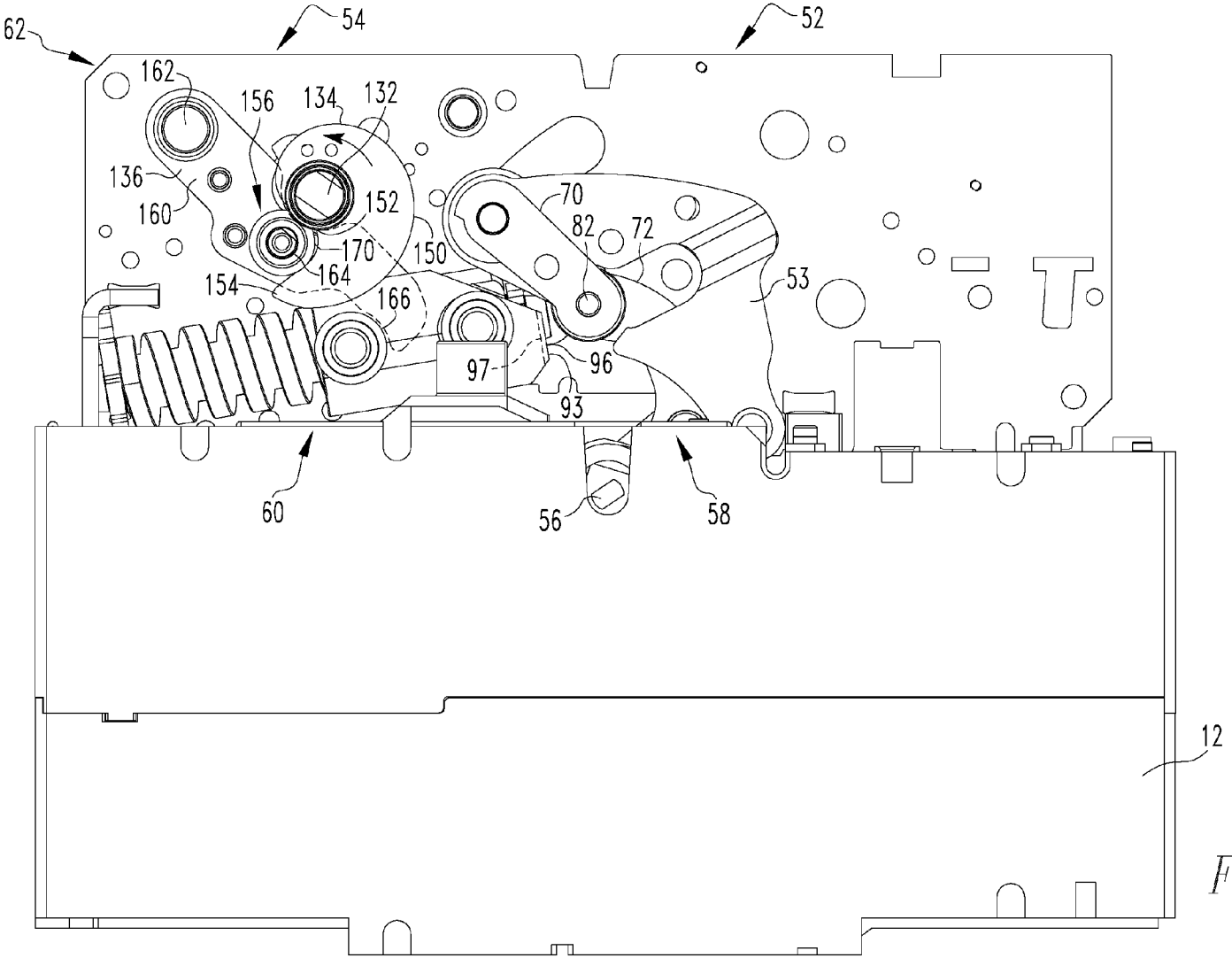
FIG. 2B is a side view of an electrical switching apparatus with a front cover removed and selected components removed for clarity and with the latch assembly in a second position.
Figure 3:
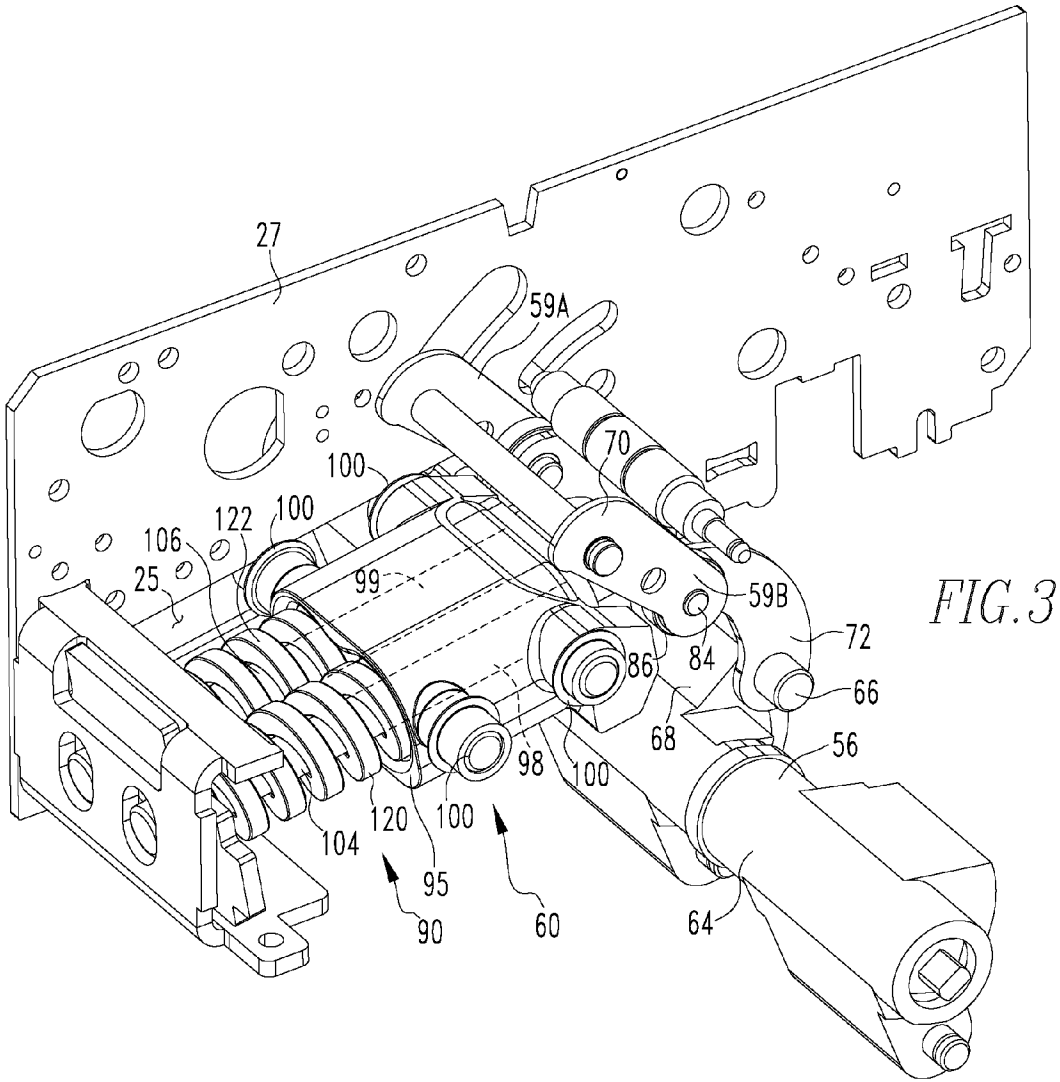
FIG. 3 is an isometric view of the closing assembly with a side plate removed for clarity.
Figure 4:
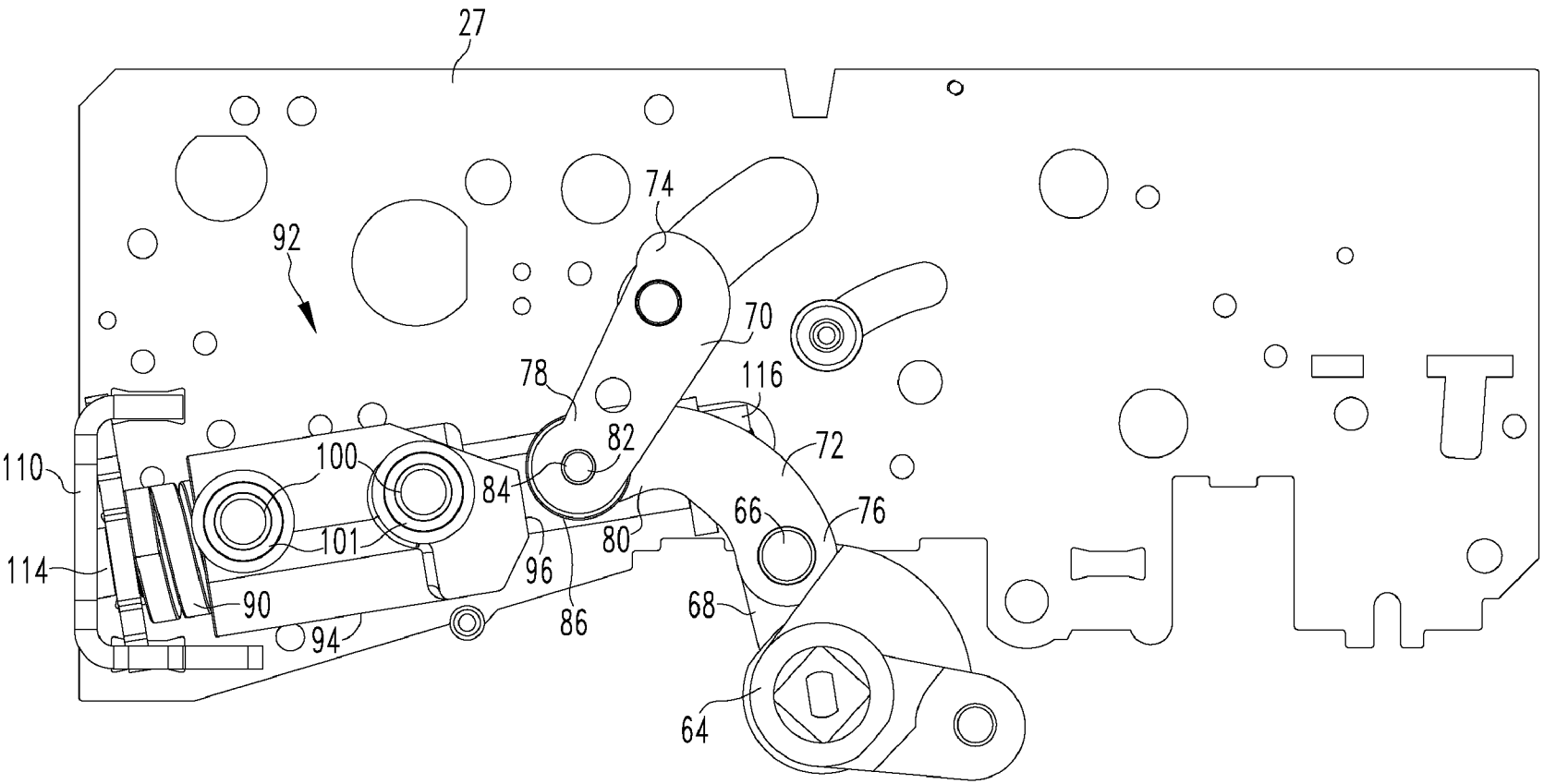
FIG. 4 is a side view of the ram assembly and the toggle assembly in a first position/configuration.

As shown in FIGS. 2-4, the closing assembly 54 includes a pole shaft 56, a toggle assembly 58, a ram assembly 60, and a charging assembly 62 (FIG. 1). The pole shaft 56 is an elongated shaft body 64 rotatably coupled to the housing assembly 12 and/or side plates 27. The pole shaft 56 includes a plurality of mounting points 66 disposed on mounting blocks 68 extending from the pole shaft body 64. The pole shaft 56 is coupled to the movable contact 34. The pole shaft 56 is structured to move between a first position, wherein the movable contact 34 is in its first, open position, and a second position, wherein the movable contact 34 is in its second, closed position.

It is noted that, as shown in FIG. 3, a single "link" in the toggle assembly 58 may include two, or more, members 59A, 59B with similar shapes which are held in a spaced relationship and which move in concert. The use of multiple link members 59A, 59B may be used, for example, to provide added strength to the link or where space considerations do not allow for a single thick link. Because these link members 59A, 59B perform the same function, have a similar shape, and move in concert, the following discussion will simply identify the link by a single reference number as is shown in the side views of FIGS. 4 and 5. It is understood that the description of a link applies to both link members 59A, 59B. Other components in the closing assembly 54 may also be constructed using various laminations or layers which sandwich each other. It is further understood that these components, such as, but not limited to, the toggle assembly members 59A, 59B and the rocker arm assembly body 160 (discussed below) each move in their own plane. The plane of travel for such components is generally parallel to the plane of the side plates 27.

Figure 5:
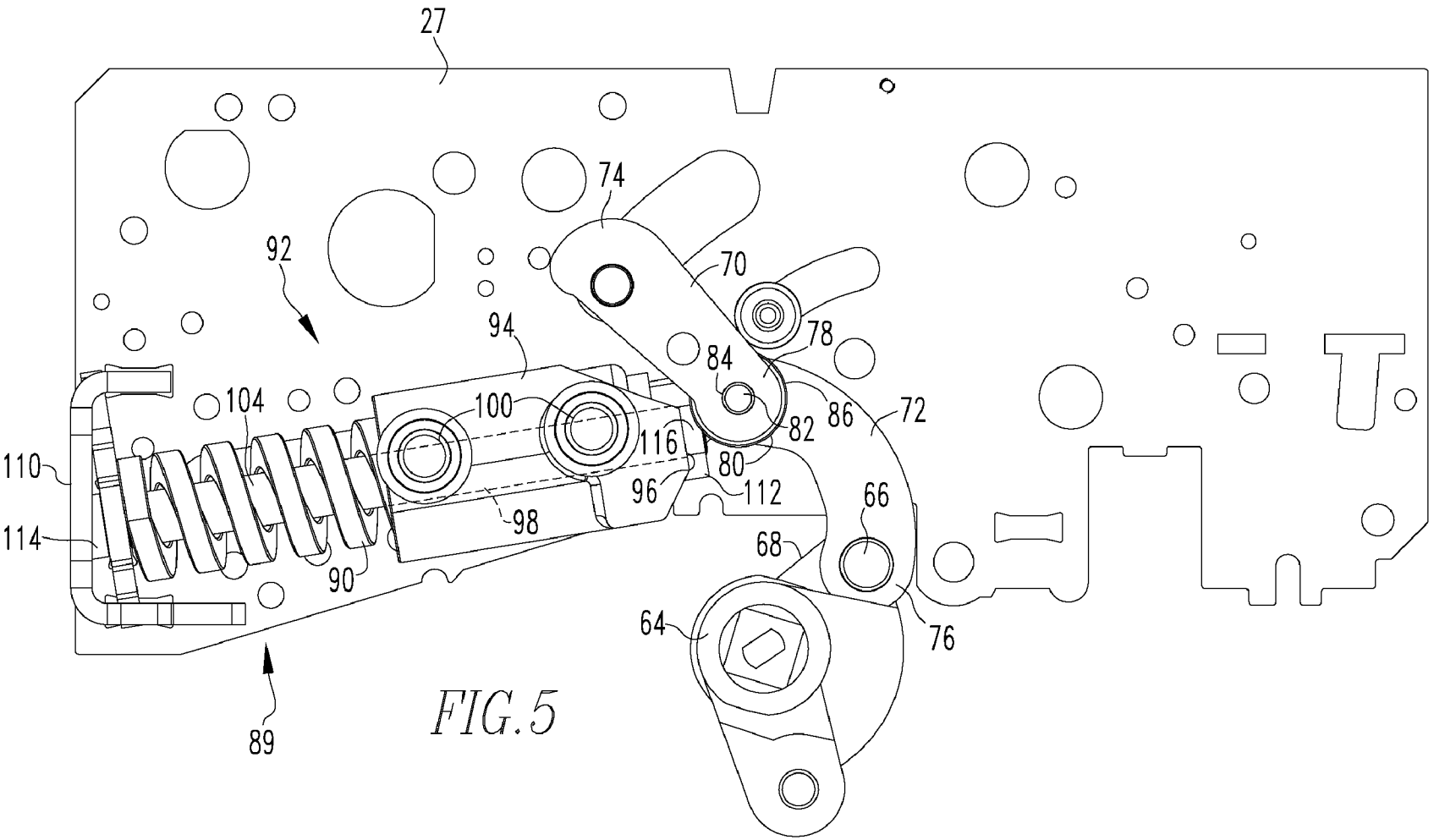
FIG. 5 is a side view of the ram assembly and the toggle assembly in a second position/configuration.

As shown in FIGS. 4 and 5, the toggle assembly 58 includes a first link 70 and a second link 72 which are each generally flat, elongated bodies. The first and second links 70, 72 each have a first, outer end 74, 76 (respectively) and a second, inner end 78, 80 (respectively). The first link 70 and the second link 72 are rotatably coupled together at the first link inner end 78 and the second link inner end 80. In this configuration, the first and second links 70, 72 form a toggle joint 82. The toggle joint 82 may include a toggle roller 86. That is, the first link inner end 78 and the second link inner end 80 may be rotatably coupled together by a pin 84 extending generally perpendicular to the plane of each link 70, 72. The pin 84 may also define an axle for the toggle roller 86 which is, essentially, a wheel. The toggle roller 86 has a diameter of sufficient size to extend past the edges of the first and second links 70, 72. The first link outer end 74 is rotatably coupled to the housing assembly 12 and/or side plates 27. For the purpose of this disclosure, the first link outer end 74 may be considered to be fixed pivot point, however, it is noted that the first link outer end 74 is movably mounted in a slot 25 on the side plate 27. The second link outer end 76 is rotatably coupled to the pole shaft 56 and, more specifically, rotatably coupled to a mounting point 66. see—136

It is noted that an axis extending through the pivot points for each link 70, 72 defines the lines of force acting through the toggle assembly 58. The toggle assembly 58 is structured to move between a first, collapsed configuration (FIG. 4) and a second, slightly over-toggle configuration (FIG. 5). While moving between the first, collapsed configuration and the second, over-toggle configuration the toggle assembly 58 and the toggle joint 82 pass through a toggle, or in-line, configuration. In the first, collapsed configuration, the lines of force acting through the toggle assembly 58 are, preferably, at an acute angle. In the in-line configuration, the lines of force acting through the toggle assembly 58 are aligned with each other. In the over-toggle configuration, the lines of force acting through the toggle assembly 58 are typically between about 5 degrees and 15 degrees past toggle and, preferably about 10 degrees past toggle. The toggle assembly 58 may be held in the over-toggle configuration by a stop pin 79. That is, the stop pin 79 prevents the toggle assembly 58 from collapsing in the reverse direction.

In the first, collapsed configuration, the first and second link outer ends 74, 76 are generally closer together than when the toggle assembly 58 is in the second, over-toggle configuration. Thus, because the first link outer end 74 is a fixed pivot point, as the toggle assembly 58 moves between the first, collapsed configuration and the second, over-toggle configuration, the second link outer end 76 is drawn toward, or pushed away from, the first link outer end 74. This motion causes the pole shaft 56 to move between its first and second positions. That is, when the toggle assembly 58 is in the first, collapsed configuration, the pole shaft 56 is in its first position, and, as noted above, the movable contact 34 is in its first, open position. Further, when the toggle assembly 58 is in the second, over-toggle configuration, the pole shaft 56 is in its second position, and, as noted above, the movable contact 34 is in its second, closed position.

The ram assembly 60 has at least one biasing device 89, preferably a compression spring 90, a guide assembly 92, and a ram body 94. The ram body 94, preferably, includes a generally flat forward surface 96 that is structured to engage the toggle joint 82, and more preferably the toggle roller 86. The ram body 94 may be solid but, in a preferred embodiment, the ram body 94 is substantially hollow having a loop-like side wall 95 (FIG. 3) coupled to cap-like a front plate 93 (FIG. 2A). The forward surface 96 is the outer surface of the front plate 93. The ram body 94 is structured to move between a first, retracted position and a second, extended position along a path of travel defined by the guide assembly 92. In one embodiment, the ram body 94 has a lateral width of about 2.1 inches and defines at least one, and preferably two passages 98, 99 (FIG. 3) extending in the direction of the path of travel. The ram body 94 may also have at least one, and preferably two rollers 100 disposed on opposite lateral sides of the ram body 94. The passages 98, 99 and the ram rollers 100 cooperate with an associated embodiment of the guide assembly 92. That is, for this embodiment, the guide assembly 92 includes at least one, and preferably two elongated, generally straight pins 104, 106 (FIG. 3) that are disposed in a spaced, generally parallel orientation. Further, the housing assembly 12 and/or side plates 27 may define slots 25 disposed on either side of the ram body 94 path of travel. When assembled, the pins 104, 106 extend through the passages 98, 99 and the ram body rollers 100 are each disposed in one of the slots 25. In this configuration, the ram body 94 is limited to a generally linear motion defined by the guide assembly 92.

The guide assembly 92 further includes a base plate 110 and a stop plate 112. Each pin 104, 106 has a base end 114 and a tip end 116. Each pin base end 114 is coupled to the base plate 110 and each pin tip end 116 is coupled to the stop plate 112 (FIG. 5). That is, the base plate 110 and the stop plate 112 maintain the pins 104, 106 in a spaced, generally parallel configuration. Further, in the embodiment described above, the base plate 110 and the stop plate 112 further limit and define the ram body 94 path of travel. That is, the ram body 94 is trapped between the base plate 110 and the stop plate 112.

The at least one spring 90 is structured to bias the ram body 94 from the first, retracted position toward the second, extended position. When the ram body 94 is in the first, retracted position, the at least one spring 90 is charged or compressed. When the ram body 94 is in the second, extended position, the at least one spring 90 is discharged. Preferably, the at least one spring 90 is disposed between the base plate 110 and a ram body back surface 97 (FIG. 2B). The ram body back surface 97 is, preferably, the interior side of the front plate 93. That is, the ram body back surface 97 is disposed on the opposite side of the front plate 93 from the forward surface 96. In the embodiment disclosed above, i.e., a ram body 94 with two passages 98, 99 and two pins 104, 106, the at least one spring 90 is preferably two springs 120, 122 and each spring 120, 122 is disposed about one of the two pins 104, 106. For a 600 volt electrical switching apparatus, wherein the closing energy required to close three pairs of contacts 26 is as much as 50 joules, the springs 120, 122 may each be about 3.5 inches long and about 0.75 inches in diameter.

As shown in FIGS. 1 and 2, the charging assembly 62 includes a charging operator 130, a cam shaft 132, a cam 134, and a rocker arm assembly 136. The charging operator 130 is a device coupled to, and structured to rotate, the cam shaft 132. The charging operator 130 may be a manually powered handle assembly 140 and/or a powered motor 142 as shown in FIG. 1. The cam shaft 132 is an elongated shaft that is rotatably coupled to the housing assembly 12 and/or side plates 27. The cam 134 is fixed to the cam shaft 132 and structured to rotate therewith about a pivot point. The cam 134 includes an outer cam surface 150. The outer cam surface 150 has a point of minimal radius 152, a point of greatest radius 154, and a stop radius 155. The cam 134 is structured to rotate in a single direction as indicated by the arrow in FIG. 2. The outer cam surface 150 increases gradually in radius from the point of minimal radius 152 to the point of greatest radius 154 in the direction of rotation. After the cam point of greatest radius 154, the radius of the outer cam surface 150 is reduced slightly over a downslope 153. The downslope 153 leads to a stop radius 155 and then a tip 157. As set forth below, the downslope 153 to the stop radius 155 is a surface to which the force from the at least one spring 90 is applied and which encourages rotation in the proper direction so that when the "close latch" releases the cam shaft 132 rotates from the stop radius 155 to the cam tip 157 where the cam follower 164 falls off the cam tip 157 and into the pocket of the cam 152. As is shown, the outer cam surface point of minimal radius 152 and the outer cam tip 157 are disposed immediately adjacent to each other on the outer cam surface 150. Thus, there is a step 156 between the point of minimal radius 152 and the cam tip 157. It is further noted that, due to the radius of the cam follower 164 (discussed below) the cam follower 164 does not engage the point of minimal radius 152, but rather engages a stop adjacent to the point of minimal radius 152.—136 separate stop The rocker arm assembly 136 includes an elongated body 160 having a pivot point 162, a cam follower 164, and a ram body contact point 166. The rocker arm assembly body 160 is pivotally coupled to housing assembly 12 and/or side plates 27 at the rocker arm body pivot point 162. The rocker arm assembly body 160 may rotate about the rocker arm body pivot point 162 and is structured to move between a first position, wherein the rocker arm body ram body contact point 166 is disposed adjacent to the base plate 110, and a second position, wherein the rocker arm body ram body contact point 166 is adjacent to the stop plate 112. As used immediately above, "adjacent" is a comparative adjective relating to the positions of the rocker arm assembly body 160. The rocker arm body ram body contact point 166 is structured to engage and move the ram body 94. As shown, the rocker arm body ram body contact point 166 engages a bearing 101 (FIG. 3) disposed about the axle of one of the ram body rollers 100. The rocker arm assembly body 160 moves within a plane that is generally parallel to the ram body 94 path of travel and, more preferably, in a plane generally parallel to the plane of the side plates 27. The rocker arm body cam follower 164 extends generally perpendicular to the longitudinal axis of the rocker arm assembly body 160 and is structured to engage the outer cam surface 150. The rocker arm body cam follower 164 may include a roller 170.

The closing assembly 54 is assembled in the housing assembly 12 as follows. The toggle assembly 58 is disposed with the first link outer end 74 being rotatably coupled to the housing assembly 12 and/or side plates 27. The second link outer end 76 is rotatably coupled to the pole shaft 56 and, more specifically, rotatably coupled to a mounting point 66. The ram assembly 60 is disposed adjacent to the toggle assembly 58 with the ram body forward surface 96 adjacent to the toggle joint 82. That is, the toggle assembly 58 and the ram assembly 60 are positioned relative to each other so that the toggle joint 82 is disposed within the ram body 94 path of travel. More specifically, the toggle joint 82 also moves through a path as the toggle assembly 58 moves between the first, collapsed configuration and the second, over-toggle configuration. The path of the toggle joint 82 is disposed, generally, within the ram body 94 path of travel. Thus, the ram body 94 is structured to engage the toggle joint 82. In a preferred embodiment, the ram body 94 path of travel does not extend to the position of the toggle joint 82 when the toggle assembly 58 is in the second, over-toggle configuration.

The rocker arm assembly 136 assembly is disposed within the housing assembly 12 adjacent to the ram assembly 60. More specifically, the rocker arm body ram body contact point 166 is disposed so as to contact the forward side, that is the side opposite the at least one spring 90, of a ram body roller 100. In this configuration, rotation of the cam 134 causes the ram body 94 to move between the second, extended position and the first, retracted position. That is, assuming the ram body 94 is in the second, extended position and the cam follower 164 is disposed on the outer cam surface 150 at a point adjacent to the outer cam surface point of minimal radius 152, then the rocker arm assembly body 160 is in the second position. Upon actuation of the charging operator 130, the cam shaft 132 and the cam 134 rotate causing the cam follower 164 to move over the outer cam surface 150. At the point where the cam follower 164 engages the outer cam surface 150, the relative radius of the outer cam surface 150 increases with the continued rotation. As the relative radius of the outer cam surface 150 is increasing the rocker arm assembly body 160 is moved to the first position. As the rocker arm assembly body 160 is moved to the first position, the rocker arm body ram body contact point 166 engages the ram body bearing 101 and moves the ram body 94 to the first position, thereby compressing the at least one spring 90. When the ram body 94 is moved to the first position, the rocker arm body cam follower 164 is disposed at the stop radius 155. When the rocker arm body cam follower 164 is disposed on the stop radius 155, the force from the at least one spring 90 is transferred via the ram body 94 and the rocker arm assembly body 160 to the cam 134. That is, the force is being applied in a generally radially inward direction. Because the cam radius at the stop radius 155 is less than at the cam point of greatest radius 154, the cam 134 is encouraged to rotate away from the cam point of greatest radius 154, i.e. toward the step 156. The rotation of the cam shaft 132 is controlled by the latch assembly 180, discussed below.

In this position, any further rotation of the cam 134 will allow the rocker arm body cam follower 164 to fall over the step 156. After the rocker arm body cam follower 164 falls over the step 156, the rocker arm body cam follower 164 does not operatively engage the cam 134. That is, while there may be some minor force applied to the cam 134 by the rocker arm body cam follower 164, this force is not significant, does not cause the cam 134 to rotate, and does not cause significant wear and tear on the cam 134. It is noted that the cam 134 may rotate due to momentum imparted by the rocker arm body cam follower 164 prior to the rocker arm body cam follower 164 to falling over the step 156. Further, as the rocker arm body cam follower 164 falls over the step 156, the rocker arm assembly body 160 is free to move to the second position as the rocker arm body cam follower 164 is now disposed adjacent to the outer cam surface point of minimal radius 152. It is observed that, when the rocker arm body cam follower 164 is disposed at the outer cam surface stop radius 155, the cam 134 engaging the rocker arm assembly 136, which further engages the ram assembly 60, maintains the at least one spring 90 in the charged state.

The cam 134 and the rocker arm assembly 136 are maintained in the charged configuration by a latch assembly 180. The latch assembly 180 includes a latch lobe 182, a latch roller 184, latch prop 186 and a latch D-shaft 188. The latch lobe 182 is fixed to the cam shaft 132 and maintains a specific orientation relative to the cam 134. The latch roller 184 is rotatably coupled to the latch prop 186 and is structured to roll over the surface of the latch lobe 182. The latch prop 186 has an elongated, generally flat body 190 having a latch roller 184 mounting 192, a pivot point 194 and a latch edge 196. The latch prop body 190 is pivotally coupled to a side plate 27 and is structured to pivot, or rock, between a first position (FIG. 2A) and a second position (FIG. 2B). In the first position, the latch edge 196 engages the outer diameter of the latch D-shaft 188 and is held in place thereby. In turn, the latch roller 184 is held in place against the latch lobe 182 and prevents the cam shaft 132 from rotating. The latch D-shaft 188 is structured to rotate in response to a user input, e.g. actuation of a solenoid (not shown). When the latch D-shaft 188 rotates, the latch edge 196 passes over the latch D-shaft 188 as is known in the art. This allows the latch prop body 190 to move into the second position. When the latch prop body 190 is in the second position, the latch roller 184 does not engage the latch lobe 182 and, due to the bias of the at least one spring 90, as discussed above, the cam shaft 132 will rotate.

In this configuration, the closing assembly 54 operates as follows. For the sake of this discussion the electrical switching apparatus 10 will be initially described in the typical condition following an over current condition. That is, the at least one pair of separable contacts 26 are in the first, open position, the pole shaft 56 is in the first position, the toggle assembly 58 is in the first configuration, the ram body 94 is in the first position and the at least one spring 90 is charged, and the rocker arm assembly body 160 is in the first position. To close the at least one pair of separable contacts 26, an operator actuates the latch assembly 180 to allow the latch D-shaft 188 to rotate as set forth above. When the cam shaft 132 is no longer retained by the latch assembly 180, the cam 134 rotates slightly so as to allow the rocker arm body cam follower 164 to fall over the step 156. When the rocker arm body cam follower 164 falls over the step 156, the rocker arm assembly body 160 is free to move to the second position as the rocker arm body cam follower 164 now engages the outer cam surface 150 at a point adjacent to the outer cam surface point of minimal radius 152. At this point, the at least one spring 90 is no longer restrained and the at least one spring 90 moves the ram body 94 from the first, retracted position toward the second, extended position. As the ram body 94 moves from the first, retracted position toward the second, extended position, the ram body forward surface 96 engages the toggle joint 82 and causes the toggle assembly 58 to move from the first, collapsed configuration to the second, over-toggle configuration. As noted above, the ram body 94 path of travel does not extend to the position of the toggle joint 82 when the toggle assembly 58 is in the second, over-toggle configuration. Preferably, the ram body 94 moves with sufficient speed and energy so that, when the ram body 94 reaches the end of the path of travel, the toggle assembly 58 is a few degrees over toggle but not at its final over toggle resting point. Once the toggle assembly 58 is over the toggle point by only a few degrees, the forces of the at least one spring 90 and whatever the remaining momentum of the ram body 94 continue the motion of the toggle assembly 58 towards the second, over-toggle configuration, thereby creating a space between the ram body forward surface 96 and the toggle joint 82.

As the toggle assembly 58 is moved into the second, over-toggle configuration, the pole shaft 56 is also moved into its second position. As the pole shaft 56 is moved into its second position, the at least one pair of separable contacts 26 are moved from the first, open position to the second closed position. At this point the closing operation is complete, however, it is preferred that the operator again engages the charging operator 130 to cause the cam 134 to rotate so that the outer cam surface point of greatest radius 154 again engages the cam follower 164. As described above, the rotation of the cam 134 to this position acts to charge the at least one spring 90. Thus, the at least one spring 90 is charged and ready to close the at least one pair of separable contacts 26 following another over current condition.

Figure 6:
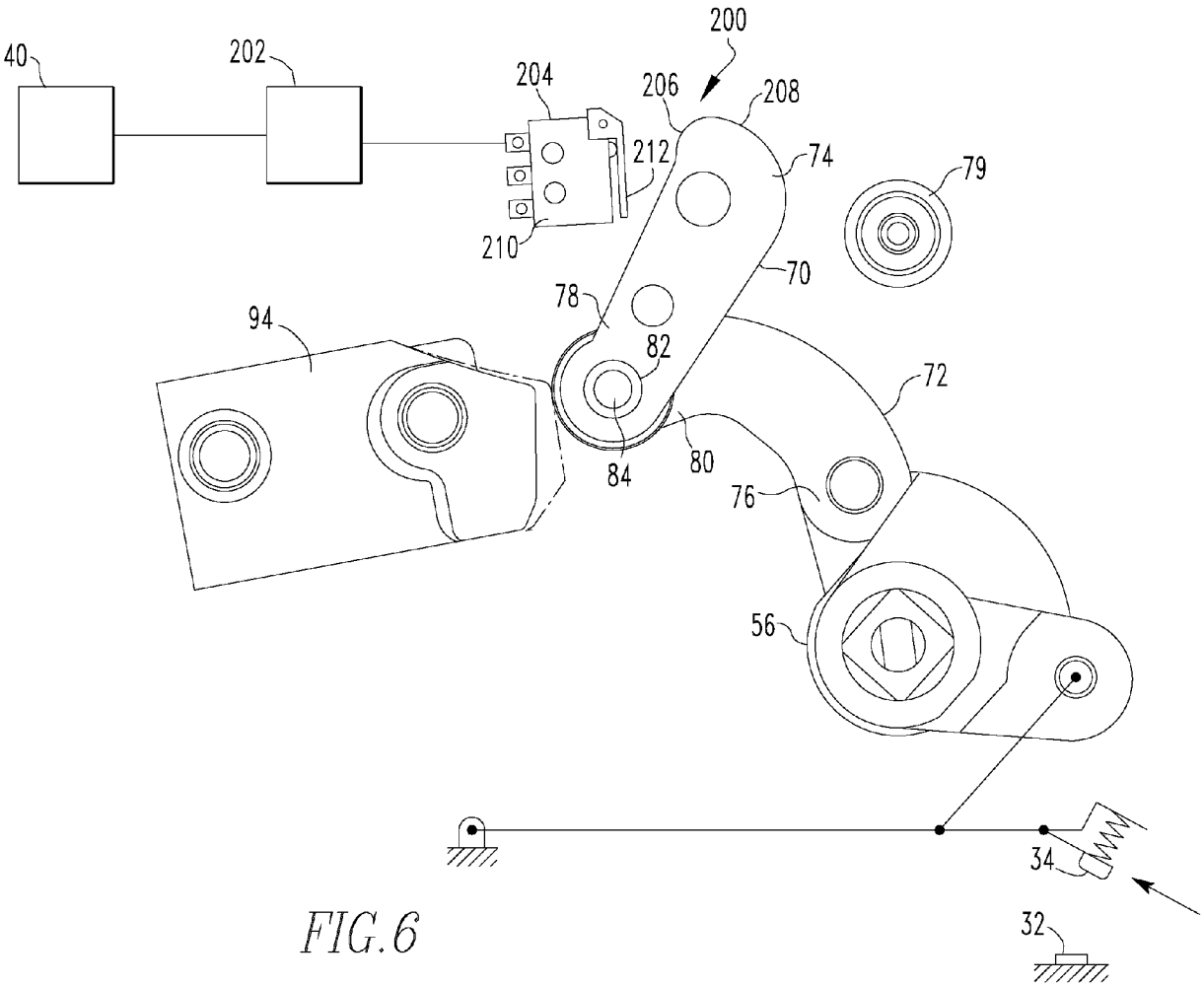
FIG. 6 is a schematic side view of the closing protection mechanism with the toggle assembly in the first, open configuration.
Figure 7:
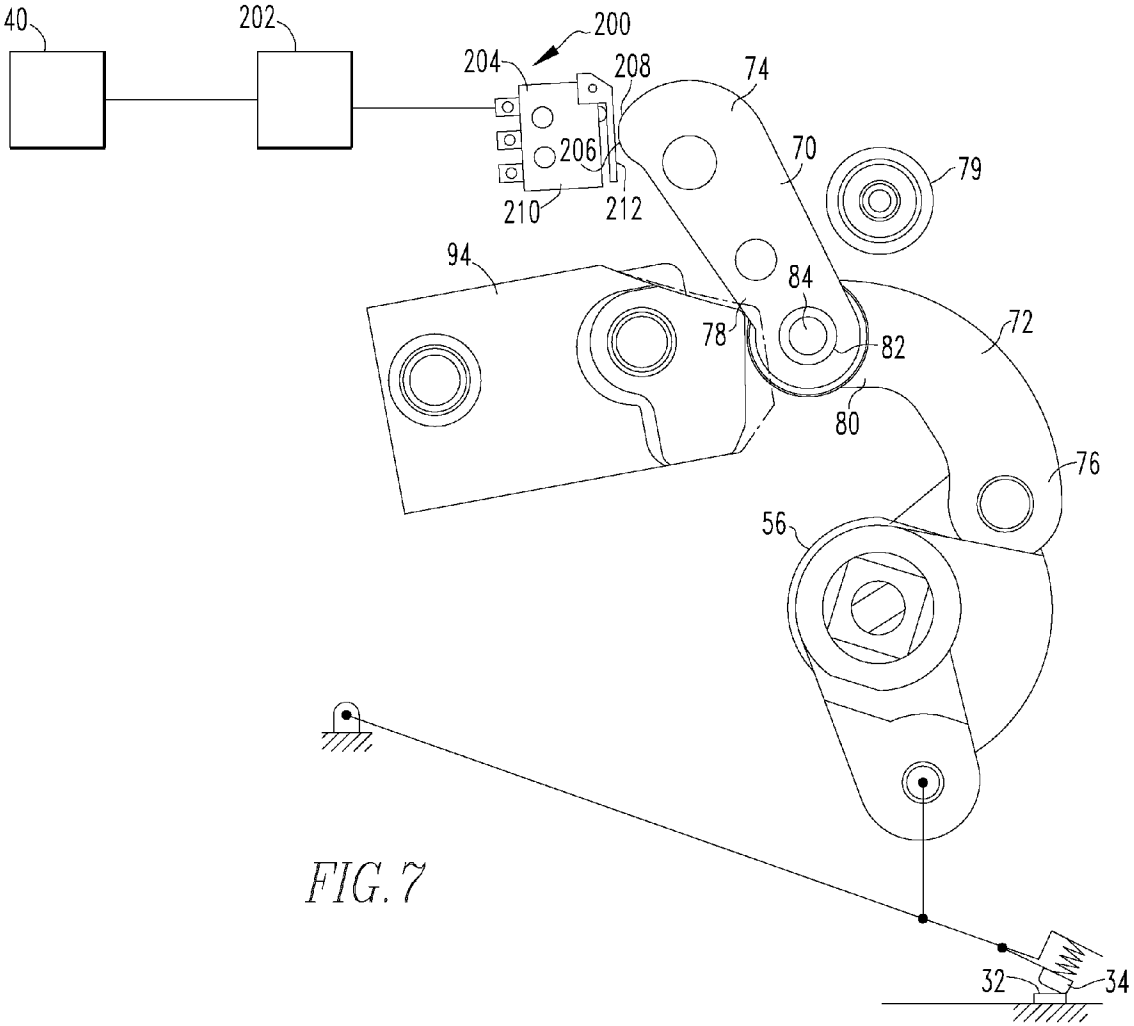
FIG. 7 is a schematic side view of the closing protection mechanism with the toggle assembly just prior to passing through the in-line configuration.
Figure 8:
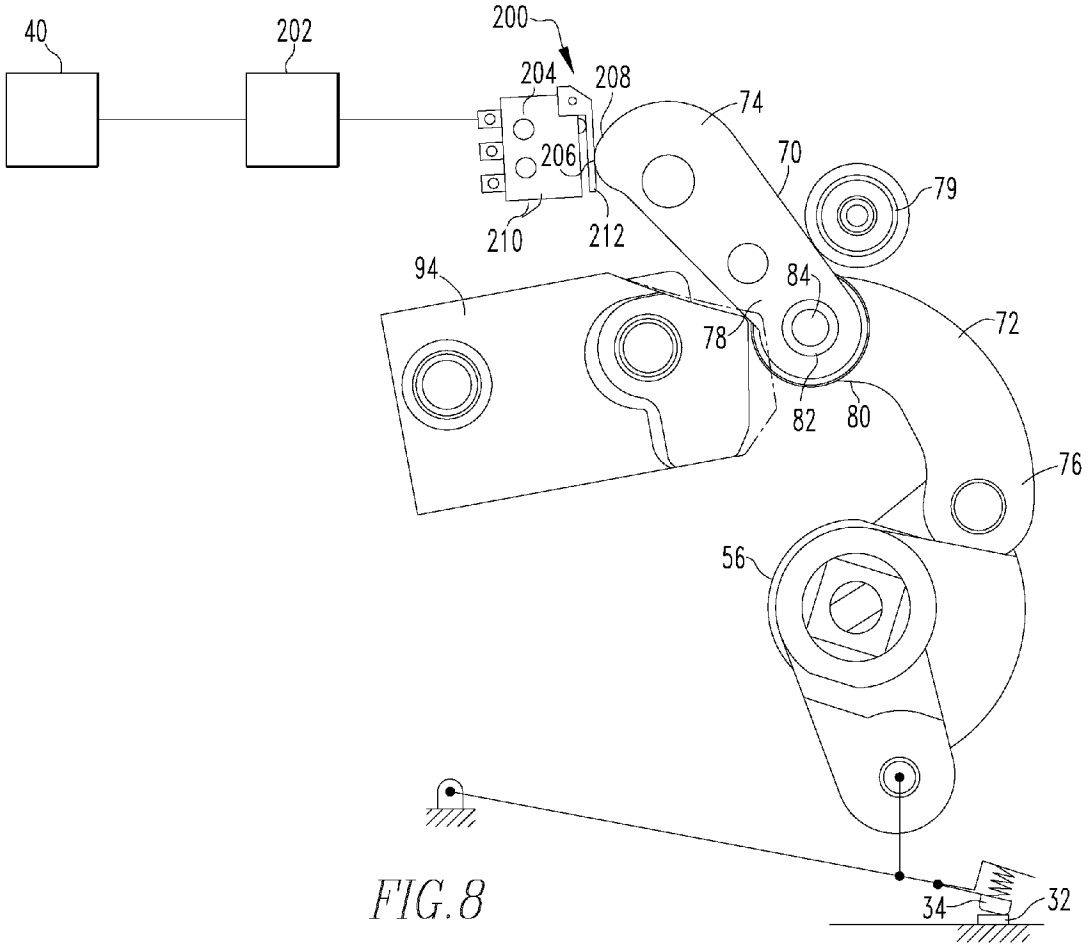
FIG. 8 is a schematic side view of the closing protection mechanism with the toggle assembly in the in-line configuration.
Figure 9:
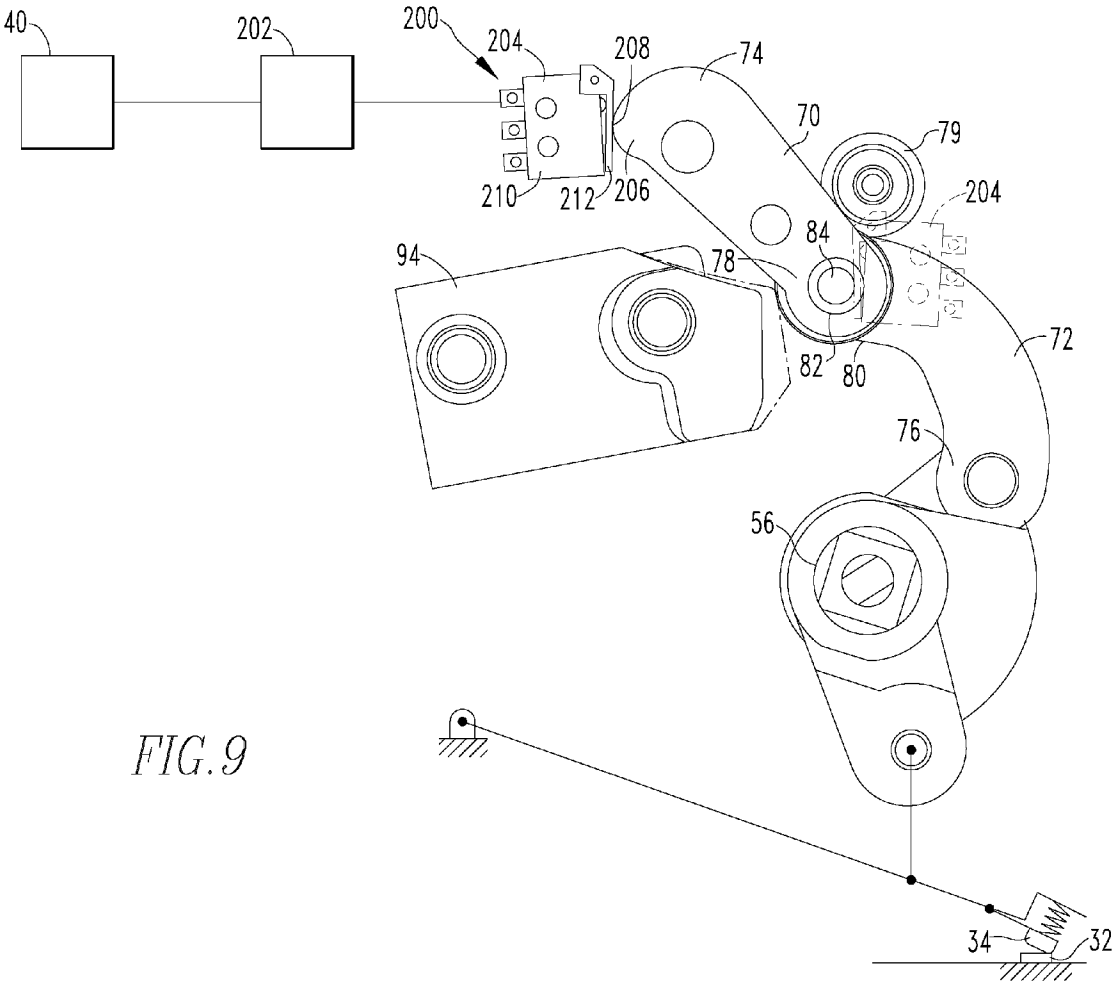
FIG. 9 is a schematic side view of the closing protection mechanism with the toggle assembly in the second, closed configuration.

The toggle assembly 58 further includes a closing protection mechanism 200. The closing protection mechanism 200 includes a control unit 202, a sensing switch 204, and a sensing switch actuator 206. The control unit 202, preferably, includes a programmable logic circuit and is structured to receive a sensing switch signal and to provide a control signal to the trip device 40. The control unit 202, shown schematically, may be incorporated into the trip device 40, shown schematically. The sensing switch 204 is coupled to, and in electronic communication with, the control unit 202 and is structured to provide a sensing switch signal to the control unit 202. The sensing switch 204 is disposed adjacent to the toggle assembly 58. The sensing switch 204, preferably, has a housing 210 and an actuator member 212. The sensing switch actuator member 212 is pivotally coupled to the sensing switch housing 210. The sensing switch actuator member 212 is structured to pivot between a first, unactuated position (FIG. 6) and a second, actuated position (FIG. 9). When the sensing switch actuator member 212 is moved into the second, actuated position, the sensing switch 204 generates the sensing switch signal and provides the sensing switch signal to the control unit 202. The sensing switch actuator member 212 is biased toward the first, unactuated position by a spring, a resilient member, or a similar device (not shown).

The sensing switch actuator 206 is structured to actuate the sensing switch 204. That is, in the preferred embodiment, the sensing switch actuator 206 is structured to engage and move the sensing switch actuator member 212 from the first, unactuated position to the second, actuated position. In the preferred embodiment, the sensing switch actuator 206 is a cam lobe 208 disposed at the first link outer end 74.

In this configuration, the sensing switch 204 is disposed adjacent to the pivot point at the first link outer end 74. When the toggle assembly 58 is in the first, collapsed configuration, the sensing switch cam lobe 208 does not engage the sensing switch actuator member 212. Preferably, as the toggle assembly 58 moves into the in-line configuration, the sensing switch actuator 206 initially engages the sensing switch actuator member 212. Then, as the toggle assembly 58 moves into the second, over-toggle configuration, the sensing switch actuator 206 moves the sensing switch actuator member 212 from the first position to the second position. When the toggle assembly 58 moves into the second, over-toggle configuration, the sensing switch 204 generates the sensing switch signal and provides the sensing switch signal to the control unit 202. The control unit 202, in turn, provides the control signal to the trip device 40.

In an alternate embodiment, shown in ghost in FIG. 9, the sensing switch 204 is disposed adjacent to the stop pin 79. As noted above, the toggle joint 82 may include a pin 84 extending generally perpendicular to the plane of each link 70, 72. The sensing switch 204 may be structured to be actuated by the toggle joint pin 84 as the toggle joint 82 moves into the second, over-toggle configuration. It is further noted that the sensing switch 204 may be placed in any position wherein the sensing switch actuator member 212 is engaged by an element of the toggle assembly 58 as the toggle assembly 58 moves over toggle so long as the sensing switch 204 does not interfere with the operation of the toggle assembly 58.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A closing protection mechanism for an operating mechanism closing assembly in an electrical switching apparatus, said electrical switching apparatus having a housing assembly, operating mechanism, a trip device, and at least one pair of separable contacts structured to move between a first, open position, wherein said contacts are separated, and a second, closed position, wherein said contacts contact each other and are in electrical communication, said operating mechanism closing assembly having a pole shaft and a toggle assembly, said pole shaft coupled to said separable contacts and structured to move said separable contacts between said first position and said second position, said toggle assembly having a first link and a second link, said first link having an outer end and an inner end, said second link having an outer end and an inner end, said first link inner end and said second link inner end rotatably coupled to each other forming a toggle joint, said second link outer end coupled to said pole shaft, said first link outer end coupled to said housing assembly, said toggle assembly structured to move between a first, collapsed configuration and a second, over-toggle configuration, passing through an in-line configuration therebetween, said closing protection mechanism comprising:

a sensing switch coupled to said housing assembly and disposed adjacent to said toggle assembly;

a sensing switch actuator disposed on said toggle assembly, said sensing switch actuator structured to actuate said sensing switch; and wherein said sensing switch structured to be actuated by said sensing switch actuator when said toggle assembly is in said second, over-toggle configuration.

2. The closing protection mechanism of claim 1 wherein said sensing switch actuator initially engages said sensing switch when said toggle assembly is in said in-line configuration.

3. The closing protection mechanism of claim 1 wherein said sensing switch actuator is disposed on said first link outer end.

4. The closing protection mechanism of claim 3 wherein:

said sensing switch includes a housing and an actuator member, said actuator member being pivotally coupled to said sensing switch housing; and said sensing switch actuator is a cam lobe extending from said first link outer end.

5. The closing protection mechanism of claim 1 wherein said toggle assembly includes a stop pin, said toggle joint structured to engage said stop pin when said toggle assembly is in said second, over-toggle configuration, and wherein:

said sensing switch is disposed adjacent to said stop pin; and said sensing switch actuator is disposed at said toggle joint.

6. An electrical switching apparatus comprising:

a housing assembly defining an enclosed space;

a plurality of side plates, said side plates disposed within said housing assembly enclosed space, generally parallel to each other, said side plates having a plurality of aligned openings therein whereby one or more elongated members may be coupled, including rotatably coupled, perpendicular to and between adjacent side plates;

at least one pair of separable contacts structured to move between a first, open position, wherein said contacts are separated, and a second, closed position, wherein said contacts contact each other and are in electrical communication;

an operating mechanism with a closing assembly having a pole shaft, and a toggle assembly;

said pole shaft rotatably coupled between a pair of adjacent side plates, said pole shaft further coupled to said at least one pair of contacts, wherein said pole shaft rotates between a first position, wherein said separable contacts are in said first, open position and a second position, wherein said separable contacts are in said second, closed position;

said toggle assembly having first link and a second link, each link having a first, outer end and a second, inner end, said first link and a second link rotatably coupled together at said first link inner end and said second link inner end thereby forming a toggle joint, said toggle assembly structured to move between a first, collapsed configuration and a second, over-toggle configuration, said toggle assembly structured to move between a first, collapsed configuration and a second, over-toggle configuration, passing through an in-line configuration therebetween;

said second link inner end rotatably coupled to said pole shaft wherein when said toggle assembly is in said first, collapsed configuration, said pole shaft is in said first position, and when said toggle assembly is in said second, over-toggle configuration said pole shaft is in said second position;

a closing protection mechanism including a sensing switch and a sensing switch actuator;

said sensing switch coupled to said housing assembly and disposed adjacent to said toggle assembly;

said sensing switch actuator disposed on said toggle assembly, said sensing switch actuator structured to actuate said sensing switch; and wherein said sensing switch structured to be actuated by said sensing switch actuator when said toggle assembly is in said second, over-toggle configuration.

7. The electrical switching apparatus of claim 6 wherein said sensing switch actuator initially engages said sensing switch when said toggle assembly is in said in-line configuration.

8. The electrical switching apparatus of claim 6 wherein said sensing switch actuator is disposed on said first link outer end.

9. The electrical switching apparatus of claim 8 wherein:

said sensing switch includes a housing and a actuator member, said actuator member being pivotally coupled to said sensing switch housing; and said sensing switch actuator is a cam lobe extending from said first link outer end.

10. The electrical switching apparatus of claim 6 wherein:

said toggle assembly includes a stop pin, said toggle joint structured to engage said stop pin when said toggle assembly is in said second, over-toggle configuration;

said sensing switch is disposed adjacent to said stop pin; and said sensing switch actuator is disposed at said toggle joint.

11. A closing protection mechanism for an operating mechanism closing assembly in an electrical switching apparatus, said electrical switching apparatus having a housing assembly, operating mechanism, a trip device, and at least one pair of separable contacts structured to move between a first, open position, wherein said separable contacts are separated, and a second, closed position, wherein said separable contacts contact each other and are in electrical communication, said trip device structured to receive a control signal and perform a selected trip procedure in response to said control signal, said operating mechanism closing assembly having a pole shaft and a toggle assembly, said pole shaft coupled to said separable contacts and structured to move said separable contacts between said first position and said second position, said toggle assembly having a first link and a second link, said first link having an outer end and an inner end, said second link having an outer end and an inner end, said first link inner end and said second link inner end rotatably coupled to each other forming a toggle joint, said second link outer end coupled to said pole shaft, said first link outer end coupled to said housing assembly, said toggle assembly structured to move between a first, collapsed configuration and a second, over-toggle configuration, passing through an in-line configuration therebetween, said closing protection mechanism comprising:

a control unit coupled to, and in electronic communication with, said trip device, said control unit structured to receive a sensing switch signal and to provide a control signal to said trip device;

a sensing switch coupled to, and in electronic communication with, said control unit, said sensing switch disposed adjacent to said toggle assembly, said sensing switch structured to provide a sensing switch signal to said control unit;

a sensing switch actuator disposed on said toggle assembly, said sensing switch actuator structured to actuate said sensing switch; and wherein said sensing switch structured to be actuated by said sensing switch actuator when said toggle assembly is in said second, over-toggle configuration.

12. The closing protection mechanism of claim 11 wherein said sensing switch actuator initially engages said sensing switch when said toggle assembly is in said in-line configuration.

13. The closing protection mechanism of claim 11 wherein said sensing switch actuator is disposed on said first link outer end.

14. The closing protection mechanism of claim 13 wherein:

said sensing switch includes a housing and a actuator member, said actuator member being pivotally coupled to said sensing switch housing; and said sensing switch actuator is a cam lobe extending from said first link outer end.

15. The closing protection mechanism of claim 11 wherein said toggle assembly includes a stop pin, said toggle joint structured to engage said stop pin when said toggle assembly is in said second, over-toggle configuration, and wherein:

said sensing switch is disposed adjacent to said stop pin; and said sensing switch actuator is disposed at said toggle joint.

16. An electrical switching apparatus comprising:

a housing assembly defining an enclosed space;

a plurality of side plates, said side plates disposed within said housing assembly enclosed space, generally parallel to each other, said side plates having a plurality of aligned openings therein whereby one or more elongated members may be coupled, including rotatably coupled, perpendicular to and between adjacent side plates;

at least one pair of separable contacts structured to move between a first, open position, wherein said contacts are separated, and a second, closed position, wherein said contacts contact each other and are in electrical communication;

an operating mechanism including a closing assembly having a pole shaft, and a toggle assembly;

said pole shaft rotatably coupled between a pair of adjacent side plates, said pole shaft further coupled to said at least one pair of separable contacts, wherein said pole shaft rotates between a first position, wherein said separable contacts are in said first, open position and a second position, wherein said separable contacts are in said second, closed position;

said toggle assembly having first link and a second link, each link having a first, outer end and a second, inner end, said first link and a second link rotatably coupled together at said first link inner end and said second link inner end thereby forming a toggle joint, said toggle assembly structured to move between a first, collapsed configuration and a second, over-toggle configuration, said toggle assembly structured to move between a first, collapsed configuration and a second, over-toggle configuration, passing through an in-line configuration therebetween;

said second link inner end rotatably coupled to said pole shaft wherein when said toggle assembly is in said first, collapsed configuration, said pole shaft is in said first position, and when said toggle assembly is in said second, over-toggle configuration said pole shaft is in said second position;

a closing protection mechanism including a control unit, a sensing switch and a sensing switch actuator;

said control unit coupled to, and in electronic communication with, said trip device, said control unit structured to receive a sensing switch signal and to provide a control signal to said trip device;

said sensing switch coupled to, and in electronic communication with, said control unit, said sensing switch disposed adjacent to said toggle assembly, said sensing switch structured to provide a sensing switch signal to said control unit;

said sensing switch actuator disposed on said toggle assembly, said sensing switch actuator structured to actuate said sensing switch; and wherein said sensing switch structured to be actuated by said sensing switch actuator when said toggle assembly is in said second, over-toggle configuration.

17. The electrical switching apparatus of claim 16 wherein said sensing switch actuator initially engages said sensing switch when said toggle assembly is in said in-line configuration.

18. The electrical switching apparatus of claim 16 wherein said sensing switch actuator is disposed on said first link outer end.

19. The electrical switching apparatus of claim 18 wherein:

said sensing switch includes a housing and a actuator member, said actuator member being pivotally coupled to said sensing switch housing; and said sensing switch actuator is a cam lobe extending from said first link outer end.

20. The electrical switching apparatus of claim 16 wherein:

said toggle assembly includes a stop pin, said toggle joint structured to engage said stop pin when said toggle assembly is in said second, over-toggle configuration;

said sensing switch is disposed adjacent to said stop pin; and said sensing switch actuator is disposed at said toggle joint.

* * * * *